United States Patent [19]

Topolay

[11] 3,955,492

[45] May 11, 1976

[54] BALER

[75] Inventor: Michael A. J. Topolay, Acton, Canada

[73] Assignee: Lo-Lift Corporation, Mississauga, Canada

[22] Filed: Mar. 10, 1975

[21] Appl. No.: 556,698

[52] U.S. Cl. ..... 100/215; 100/50; 100/218; 100/226; 100/255; 100/256; 100/269 R

[51] Int. Cl.[2] ..... B30B 15/30; B30B 15/32

[58] Field of Search ..... 100/215, 218, 226, 255, 100/256, 50, 269 R

[56] References Cited

UNITED STATES PATENTS

| | | | |
|---|---|---|---|
| 1,133,048 | 3/1915 | Lundahl | 100/226 |
| 2,970,533 | 2/1961 | Allen | 100/255 X |
| 3,280,727 | 10/1966 | Jonas | 100/218 X |
| 3,386,374 | 6/1968 | Tezuka | 100/226 X |
| 3,469,530 | 9/1969 | Walker et al. | 100/215 |
| 3,575,104 | 4/1971 | Aluotto | 100/218 |

*Primary Examiner*—Billy J. Wilhite

[57] ABSTRACT

A baler comprises a container with an upper open end, a lid hinged on a rear upper edge of the container and a platen mounted on the lid for compressing the material to be baled. The platen slides up and down through a hole in the lid, and hydraulic rams are used for lowering and raising the platen and for lifting and lowering the lid together with the platen. The container has an upper front door which is hinged at its lower end on a horizontal axis and there is a linkage between the lid and the door so that when the lid and platen are pivoted upwardly and rearwardly, the door pivots downwardly and forwardly, with the result that a hopper mouth of large area is formed into which the material to be baled can be placed.

7 Claims, 10 Drawing Figures

BALER

BACKGROUND OF THE INVENTION

1. Field of the Invention

This invention relates to a baler for compacting and forming into convenient-sized bales any form of material, such as metal scrap, garbage, paper waste or textile materials.

2. Description of the Prior Art

Known balers suffer from the disadvantage that the entry or opening into which material is loaded is inconveniently small in area so that there are difficulties in introducing the material into the baler.

Furthermore, the known balers are relatively large, massive structures which are difficult to transport from one location to another and usually are mounted in a fixed manner on secure, immovable, support structures. This results in the disadvantage that the material to be baled has to be carried to the baler from the area where the material is produced or available.

SUMMARY OF THE INVENTION

It is an object of the present invention to provide a baler which can easily be loaded with material to be baled through a hopper mouth of large area.

It is a further object of the present invention to provide a baler which can be constructed as a light weight, portable structure which can be moved easily from one location to another, so that the baler can be brought conveniently close to the supplies of material to be baled.

The baler of the present invention comprises a container having an open upper end for introducing material to be baled and a platen mounted on a support at the upper end of the container. The platen is movable relative to the support in up and down movement in the container, and connecting means are provided between the support and the container permitting the support together with the platen to be swung upwardly toward a rear side of the container. A door is pivotally connected on the container at an upper region of a front side thereof. First drive means connected to the platen are operable to move the platen up and down in the container for compressing material therein and second drive means connected to the support are operable to swing the platen together with the support upwardly and rearwardly and to return them downwardly and forwardly. Linkage means between the support and the door provide for the door to swing forwardly and downwardly as the platen and the support swing upwardly and rearwardly.

BRIEF DESCRIPTION OF THE DRAWINGS

The invention can best be described in conjunction with the drawings in which.

DESCRIPTION OF THE PREFERRED EMBODIMENT

Figure 1:
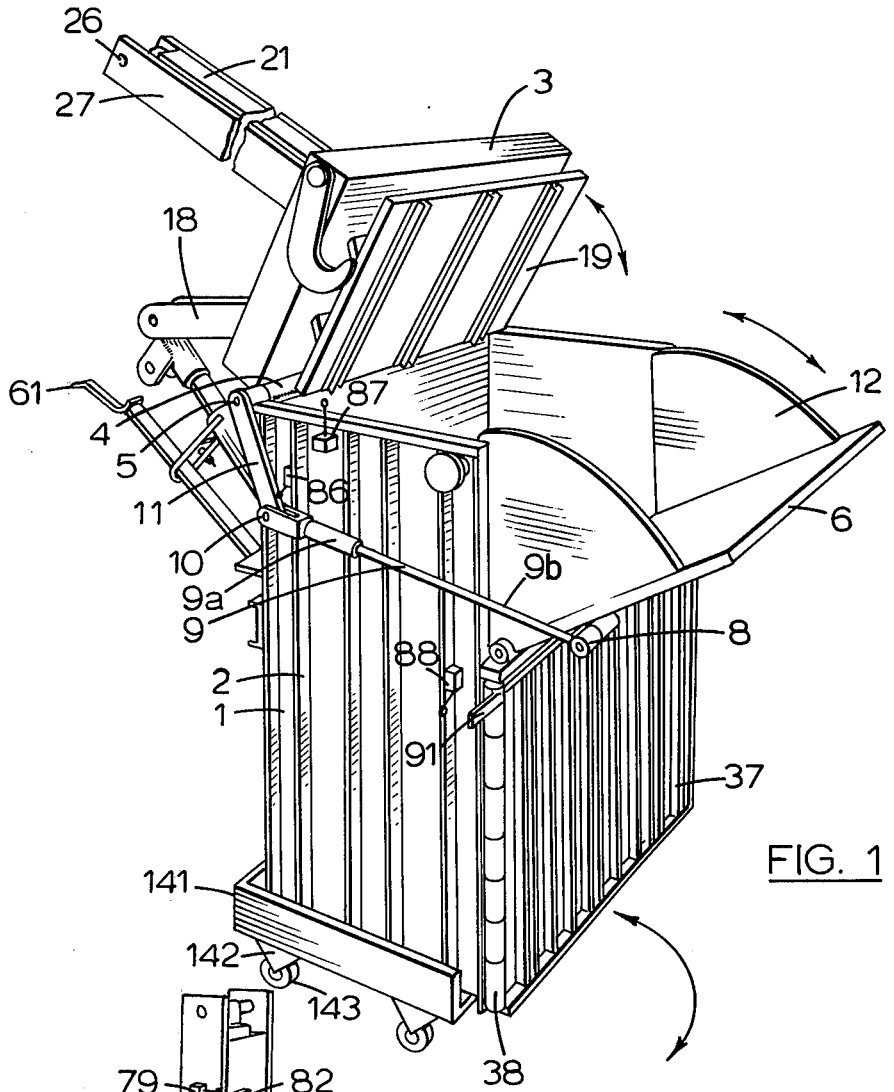
FIG. 1 is a perspective view of the baler in the open position.

Referring to FIGS. 1 to 5, the baler comprises a container body 1 on the exterior of which are welded reinforcing ribs 2. A hollow, tray-like lid 3 has its rear edge pivotally connected to an upper edge of the body 1 through a hinge 4 which includes a pivot rod 5 secured to the lid. The hinge 4 permits the lid to swing between the open position shown in FIG. 1 and the closed position shown in FIGS. 2 to 4.

An upper front door 6 is pivotally connected by a hinge 7 at its lower edge to the front of the body 1. The door 6 is connected to the lid 3 through linkages provided on either side of the body. Each linkage comprises a pivotal connection 8 between the front face of the door 6 and a generally horizontal arm 9 and a downwardly extending lever 11 which is pivotally connected to the arm 9 by a pin 10 and secured to the pivot rod 5 of the lid 3.

The linkages between the lid 3 and door 6 cause the lid and door to move in unison, so that when the lid is raised the door is opened and, conversely, the door shuts as the lid closes. The arm 9 is made in two portions, a rear part **9*a* and a forward part 9*b*, and the part 9*b* can be slidingly adjusted within the part 9*a* to allow the extent of opening of the door 6 to be adjusted. These related movements of the lid 3 and door 6 ensure that when the lid 3 is raised a hopper mouth of large area, into which material to be baled can be placed, is provided at the upper end of the body 1. Side walls 12 are provided on the rear face of the door 6, which constitute side walls of the hopper when the door 6** is open.

An hydraulic system is provided for raising and lowering the lid 3. An hydraulic cylinder 13 (best seen in FIG. 4) is pivotally connected at 14 between ears 15 which project from the rear of the body 1 and the ram 16 of the cylinder is pivotally connected at 17 to an arm 18 secured to the lid 3. This arrangement provides for the lid 3 to be raised and lowered as the ram 16 retracts into and extends from the cylinder 13, respectively.

A platen 19, for compressing material within the container 1, is supported on the underside of the lid 3. The platen 19 is secured to a square-section upwardly-extending guide tube 21 (best seen in FIG. 3) which extends through an aperture in the lid 3. A pin 22 passes through the lower end of the tube 21 and connects the lower end of a further hydraulic cylinder 23 to the tube 21. The ram 24 of the cylinder 23 is connected by a pin 26 to the upper end of a pair of braces 27 between which the guide tube 21 extends, and the braces 28 are secured at their lower ends to the lid 3. As the ram 24 is retracted and extended, the platen 19 and guide tube 21 are raised and lowered within the container body 1.

The aperture in the lid 3 through which the guide tube 21 passes is defined laterally by the exterior walls of channel-section members 29 fixed within the structure of the lid 3, and these members avoid undue lateral movement of the guide tube 21 relative to the lid, ensuring that an adequate clearance is kept between the edges of the platen 19 and the interior surfaces of the body 1 as the platen moved up and down.

Figures 4, 5:
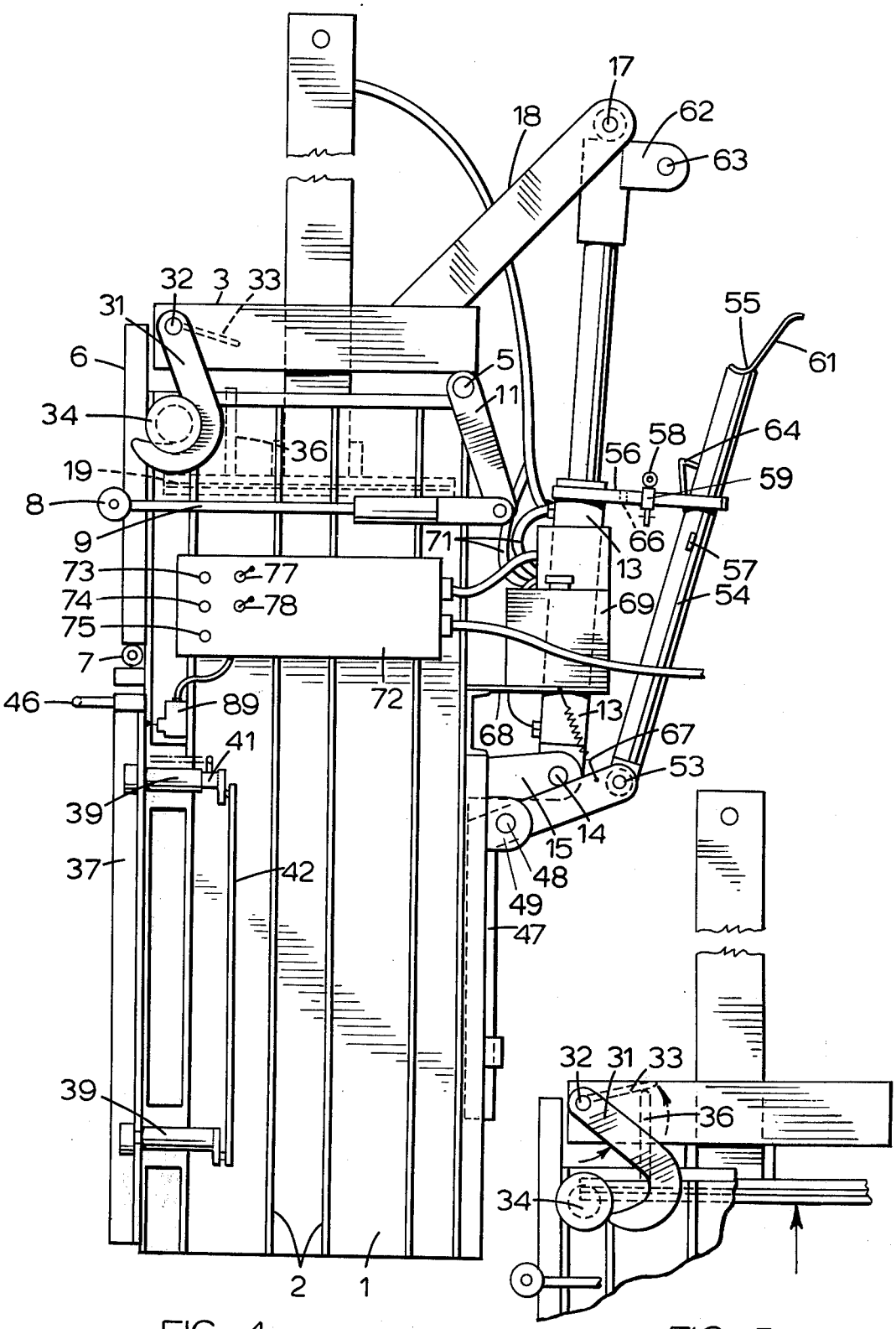
FIG. 4 is a side view of the baler in the closed position.
FIG. 5 is a side cut-away view of the upper portion of the baler.

A hook 31 is pivotally connected on each side of the lid 3 near its front edge by pivot pins 32 passing through the side walls of the lid 3. A lever 33 is rigidly connected to each pivot pin 32 internally of the lid 3. The hooks 31 are arranged so that as the lid closes, they swing forwardly through force of gravity to lock with locking posts 34 which extend from either side of the container body at its upper end thus locking the lid in the closed position. A pair of rods 36 are secured on the upper surface of the platen 19 in positions underlying the levers 33, so that when the platen 19 is raised to its uppermost point, the rods 36 pass upwards through holes in the base of the lid 3, strike the levers 33 as shown in FIG. 5 and swing the hooks 31 free of the posts 34, permitting the lid 3 to be raised.

A lower front door 37, which when open permits a completed bale to be removed from the body 1, is connected by a hinge 38 along a vertical front edge of the container body 1. On the opposite front edge of the body 1 two spaced bearings 39 are secured, through each of which rotatable shafts 41 pass. The shafts 41 are interconnected by a rod 42 so that they rotate together, and latch members 43 are connected on the front ends of the shafts 41. A lever 44 is connected on the upper of the two shafts 41 and the lever 44 can be pivoted to rotate the shafts 41 and move the latch members 43 between the locking position, shown in solid lines in FIG. 3, in which the door 37 is held closed, and the unlocked position, shown in broken lines, permitting the door 37 to be opened. A handle 46 is connected to the upper corner of the door 37 remote from the hinge 38 for use in opening the door.

On the rear of the container body 1, a spaced pair of angled kicker levers 47 are provided for use in ejecting a completed bale from the body 1. In horizontal cross-section, the interior of the baler body 1 is slightly narrower towards the rear, to facilitate the ejection of the bale. Each of the levers 47 is pivotally mounted near its angle on a pivot pin 48 passing through a pair of ears 49 secured to the rear of the body 1. Slots 51 aligned with the kicker levers 47 are formed in the rear face of the body 1, to permit the levers 47 to swing into the body 1 when ejecting the bale. The two levers are connected by a cross-shaft 52 the ends of which are rotatably connected through bearings 53 at the ends of the levers 47. The cross-shaft 52 is rigidly connected to an upwardly extending arm 54 which has an upwardly-directed recess 55 at its upper end. The arm 54 is retained adjacent the hydraulic cylinder 13 of the lid-opening mechanism by a rigid loop 56 secured on the cylinder 13 and extending around the arm 54.

A lug 57 projects from one side of the arm 54 for engagement with a gate pin 58 sliding in a socket 59 secured on one side of the loop 56. With the gate pin 58 lifted, the arm 54 can be rocked towards the cylinder 13 by grasping a handle 61 at the arm 54's upper end and the gate pin 58 can then be lowered to engage the rear surface of the lug 57 and hold the arm 54 generally parallel with the cylinder 13. The upper end of the ram 16 of the cylinder 13 carries two spaced ears 62 between which is secured a cross bar 63, for engagement with the recess 55 in the upper end of the arm 54 when the ram 16 is lowered, to operate the kicker levers 47.

A cam 64 inclining forwardly in the upward direction projects from the inner side of the arm 54 for reaction with a cross piece 66 secured between the rearwardly extending arms of the loop 56 as the arm 54 is pushed downwardly.

A tension spring 67 is connected between the upper end of the kicker levers 47 and bracket 68 secured on the rear face of the container body. The spring 67 assists in returning the kicker levers 47 to their rest position after operation.

The bracket 68 supports hydraulic fluid pumping and distribution apparatus 69 to be described in detail later which powers the hydraulic cylinders 13 and 23. Tubing 71 connects the cylinders to the pumping and distribution apparatus 69.

On one side of the container body is placed the electrical apparatus which regulates the hydraulic apparatus, and the electrical control panel 72 is visible in FIG. 4. The panel 72 carries three spring-returned push button switches 73 to 75 which are designated start, stop and up buttons, respectively and two on-off toggle switches 77 and 78 which are designated as power on-off, and hold switches respectively. The functions of these switches will be described in detail later.

Three pairs of sensor limit switches connect with the electrical control apparatus. A first pair 79 and 81, hereafter referred to as the "ram up" and "ram down" switches, are spaced apart of one side of the braces 27 and are actuated by a lateral projection 82 on the guide tube 21 which moves with the platen 19. The ram down switch 81 is mounted on a slide 83 and, can be fixed in position by a set screw 84. The switches 79 and 81 are actuated at upper and lower positions of the platen 19.

Figure 2:
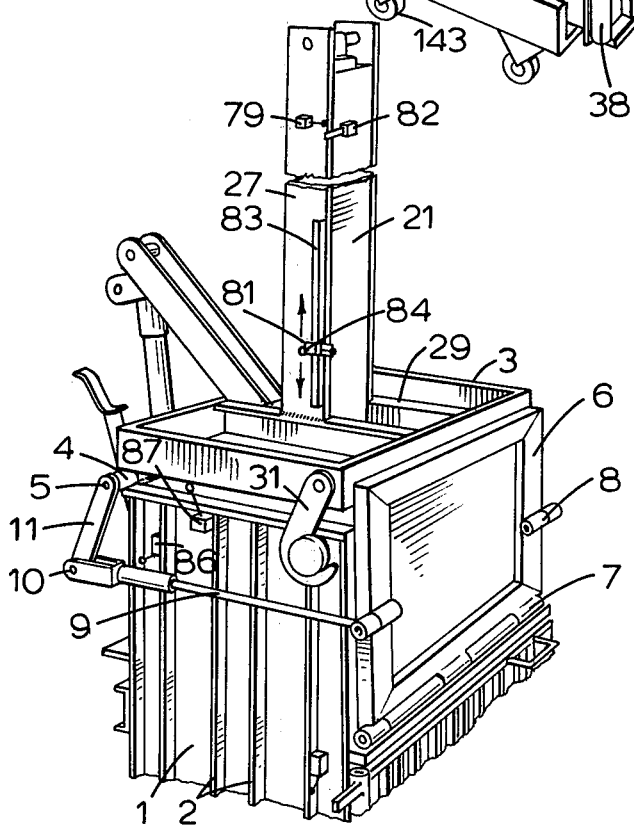
FIG. 2 is a perspective view of the upper portion of the baler in the closed position.

A second pair of switches 86 and 87, referred to as "lid up" and "lid down" switches, are mounted on the container body 1 adjacent the lever 11 and the upper edge of the container body 1, as shown in FIGS. 1 and 2 and are actuated when the lid 3 is in the open and closed positions, respectively.

The third pair of switches 88 and 89 referred to as "door open" and "door closed" switches are mounted on opposite sides of the container body 1 adjacent the upper edge of the lower door 37. The switch 88 is actuated when the lower door 37 is fully open by an arm 91 connected on the door 37 near the hinge 38. The switch 89 is actuated by the rear side of the door 37 when fully closed.

Figure 6:
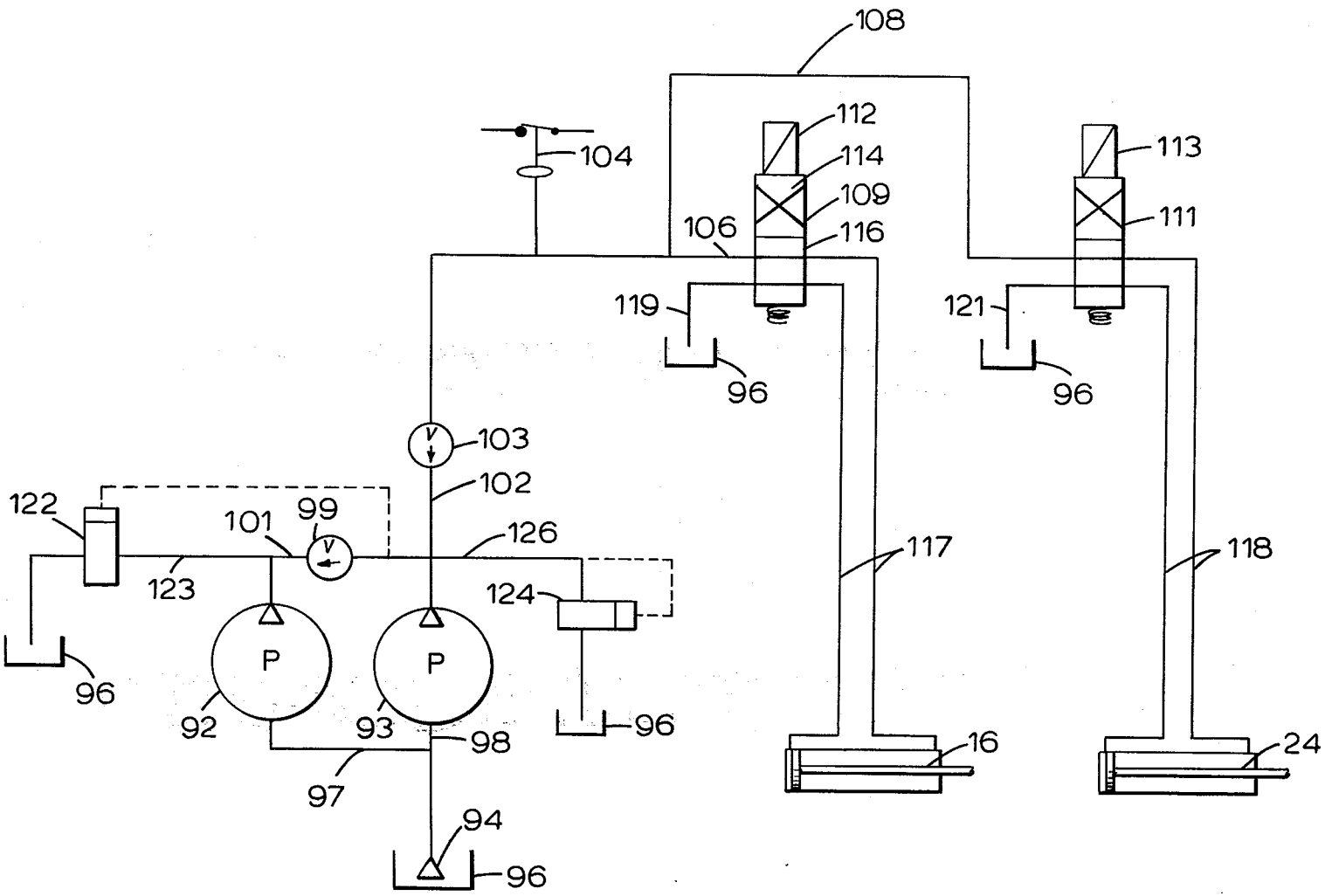
FIG. 6 is a circuit diagram of the hydraulic drive system of the baler.

Turning now to FIG. 6, the hydraulic system comprises pumps 92 and 93 driven by a common electric motor. The pumps are fed through a filter 94 with hydraulic fluid from a sump 96 along lines 97 and 98, respectively. At the normal motor speed, pump 92 delivers 3 gallons per minute and pump 93 1 gallon per minute. Pump 92 supplies fluid through a check valve 99 along line 101 joined to a supply line 102 from pump 93. A check valve 103 is connected in the line 102, and a pressure switch 104 which operates when the hydraulic pressures reaches 1750 psi. is connected to line 102. The line 102 feeds fluid through lines 106 and 108 to two spring-return valves 109 and 111 which are operated by solenoids 112 and 113 respectively. Each valve consists of two valve halves one of which has cross-over ports 114, and the other of which, 116, provides for straight-through flow. The valves 109 and 111 connect with the hydraulic cylinders 13 and 23 along double lines 117 and 118 respectively. Return lines 119 and 121 return fluid from the cylinders 13 and 23, respectively, to the sump 96.

A pressure-responsive dump valve 122 connected to pump 92 along a line 123 is set to respond to a pressure of 400 psi. in the line 102 and dumps fluid from the pump 92 to the sump 96 when this pressure is reached, so that when the hydraulic system is highly pressurised, as when the compactor ram 73 is compressing material to be baled, the motor driving the pumps is not over loaded through driving the high flow rate pump 92.

A pressure responsive dump valve 124 is connected to the line 102 along a line 126, and set to respond to a pressure of 1800 psi. in the line 102 to dump fluid from the line 102 to the sump 96 when this pressure is reached. The valve 124 acts as a safety valve ensuring that the pressure in the hydraulic system cannot exceed 1800 psi.

The operation of the baler will now be described with reference to the hydraulic and electric circuit diagrams of FIGS. 6 and 7 and the remaining Figures of the drawings.

Starting with the lid 3 in the upper position, material to be baled is loaded into the open upper end of the body 1 and falls to the bottom as shown at 127.

Figure 7:
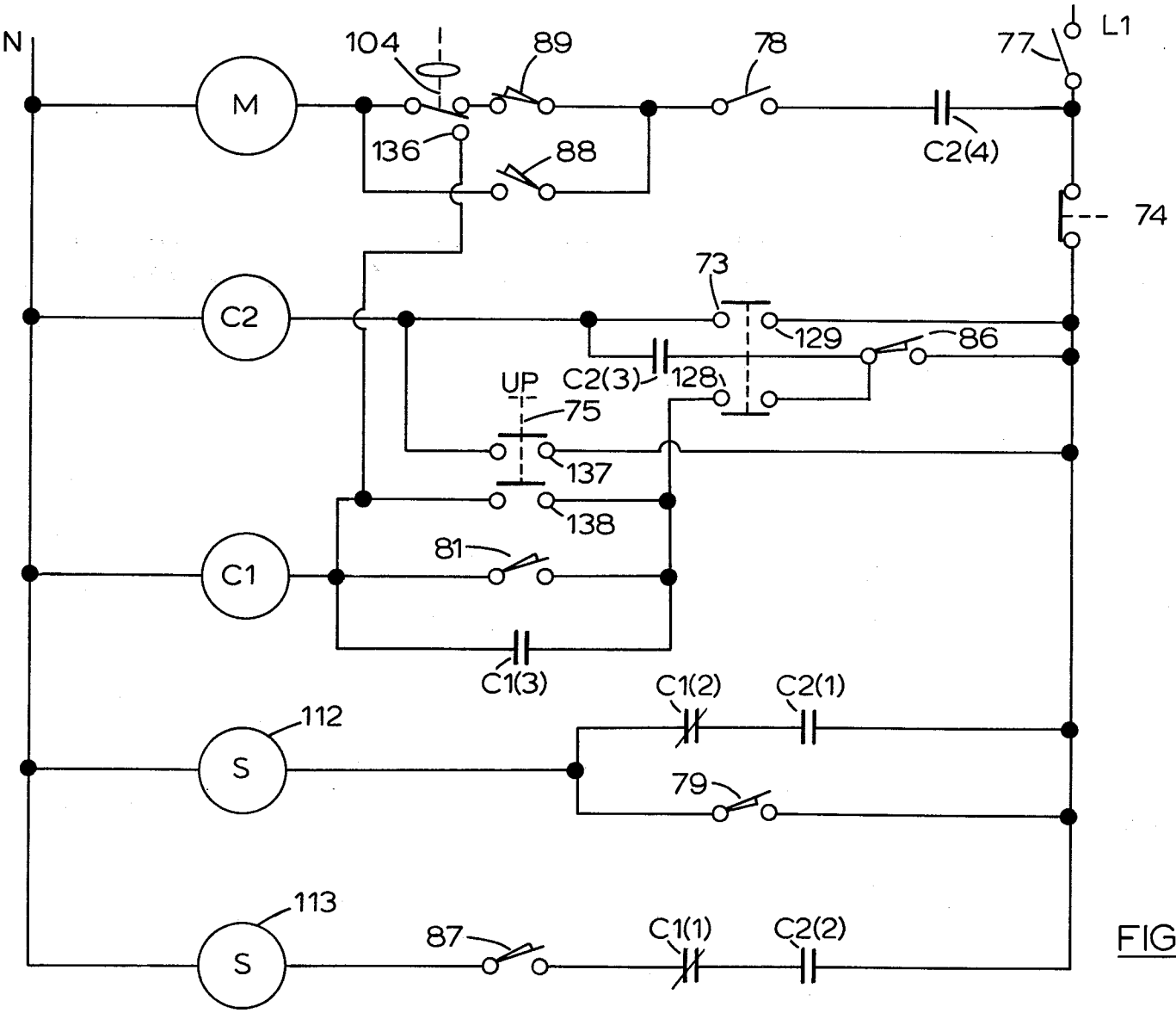
FIG. 7 is a circuit diagram of the electrical control apparatus of the baler.

In the diagram of FIG. 7 the coils $C_1$ and $C_2$ of two relays are shown, the relay having contacts $C_1(1)$ to $C_1(3)$ and $C_2(1)$ to $C_2(4)$. Contacts $C_1(3)$ and $C_2(1)$ to $C_2(4)$ are normally open while contacts $C_1(1)$ and $C_1(2)$ are normally closed. When the main switch 77 is closed, the baler can be started by pressing the push button switch 73 which disconnects the normally connected contacts 128 and connects normally disconnected contacts 129.

The relay coil $C_2$ is thereby energised and contacts $C_2(1)$ to $C_2(4)$ become closed. Since the normally open door closed switch 89 is closed, and the normally closed pressure switch 104 is closed, the motor M is connected through the contacts $C_2(4)$ and starts to drive the pumps 92 and 93.

The closed contacts $C_2(1)$ connect the solenoid 112, so that the valve 109 changes state and the feed of hydraulic fluid from the pumps 92 and 93 passes through the cross-over portion of the valve 109 to the hydraulic cylinder 13 to lower the lid 3. The lid 3 moves off the normally closed lid up switch 86 and the relay coil $C_2$ is kept in circuit and energised through the closed contacts $C_2(3)$.

While the lid 3 is moving down, the hydraulic feed through the second valve 111 pressurises the cylinder 23 so that the platen ram 24 is held in the upper position.

When the lid 3 closes, the normally open lid down switch 87 becomes closed and the solenoid 113 is energised. The valve 111 changes state so that the cylinder 23 is fed through the cross-over portion of the valve 111 and the ram 24 forces the platen 19 down to the position shown in FIG. 9 and the material in the baler is compacted.

While the platen is moving down, the feed through 117 to the cylinder 13 keeps the lid 3 firmly closed.

The downward movement of the platen 19 continues until the arm 82 on the guide tube strikes the normally open ram down switch 81 which then becomes closed.

Relay coil $C_1$ becomes connected and contacts $C_1(3)$ become closed and the coil $C_1$ is kept in circuit and energised. The normally closed contacts $C_1(1)$ and $C_1(2)$ become opened. Since $C_1(1)$ are open, solenoid 113 is de-energised and the second valve 111 reverts to its normal state so that fluid is fed to the cylinder 23 to raise the ram 24 and the platen 19.

It should be noted that the stroke of the platen 19, and hence the size of bale which is formed can be varied by adjusting the position of the ram down switch 81 on the slide 83.

Upward movement of the platen 19 continues until the arm 82 strikes the normally closed ram up switch 79. The solenoid 112 becomes de-energised so that the first valve 109 reverts to its normal state. The hooks 31 on the lid 3 become unlocked by upward movement of the rod 36 on the platen 19, as shown in FIG. 5. The hydraulic feed through the straight-through flow portion 116 of the first valve 109 to the cylinder 13 raises the lid 3 until the lever 11 strikes the normally closed lid open switch 86, with the lid in the original open position as shown in FIG. 1.

The switch 86 becomes open and disconnects the relay coils $C_1$ and $C_2$, and the contacts of these relays revert to their original state.

With the contacts $C_2(4)$ open, the motor M is disconnected and the pumps 92 and 93 stop. Pressure is held on the hydraulic lines 106 and 108 by the check valve 103.

Further material can then be added to the baler for compaction and the above cycle can be repeated.

Figure 9:
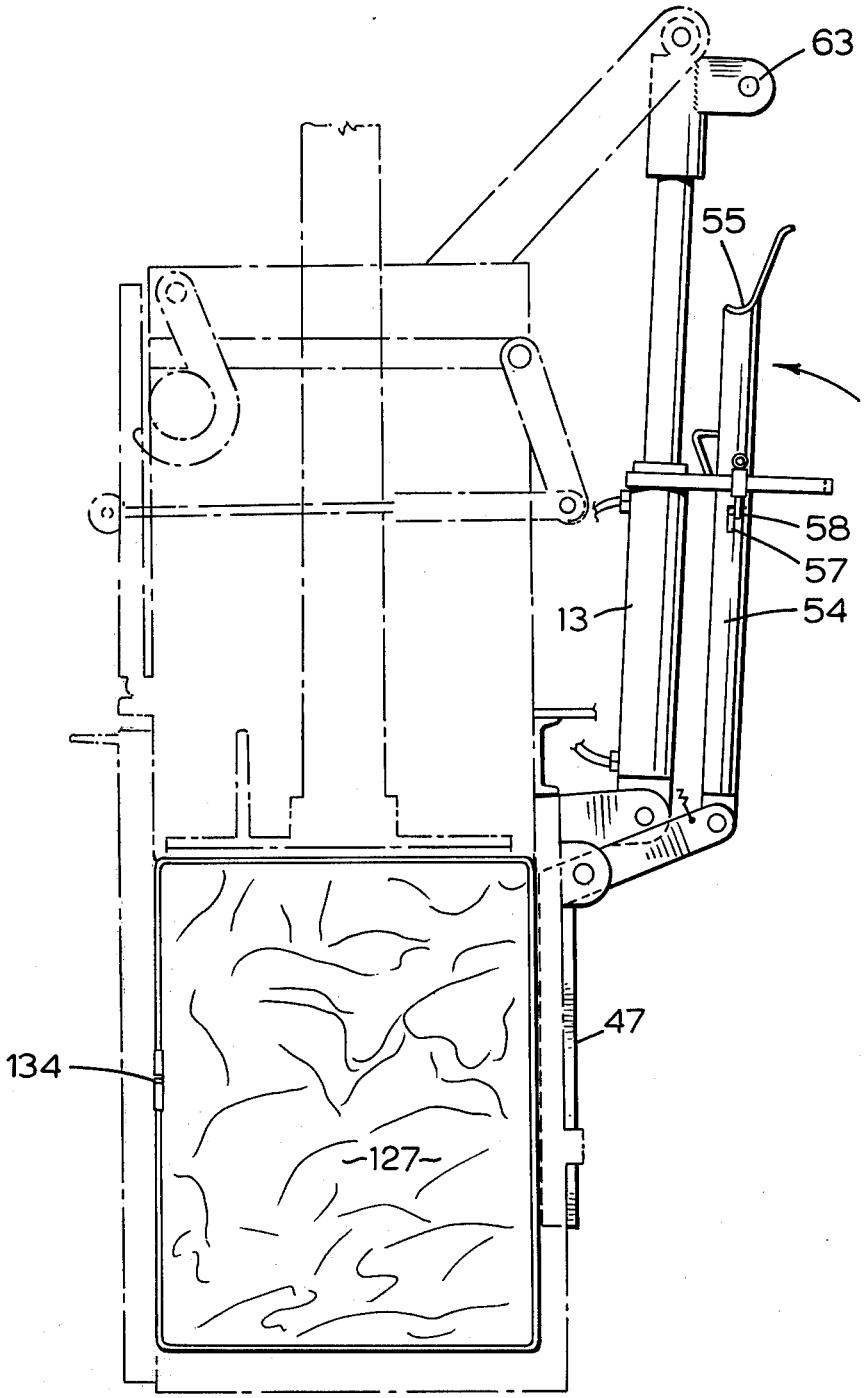

When maximum compaction of the material in the baler has been reached, with the platen 19 in the down position shown in FIG. 9, the pressure in the hydraulic lines 106 and 108 will rise until the pressure switch 104 becomes actuated. This disconnects the motor M and stops the pumps 92 and 93 while pressure on the cylinders 13 and 23 is held by the check valve 103.

Figure 3:
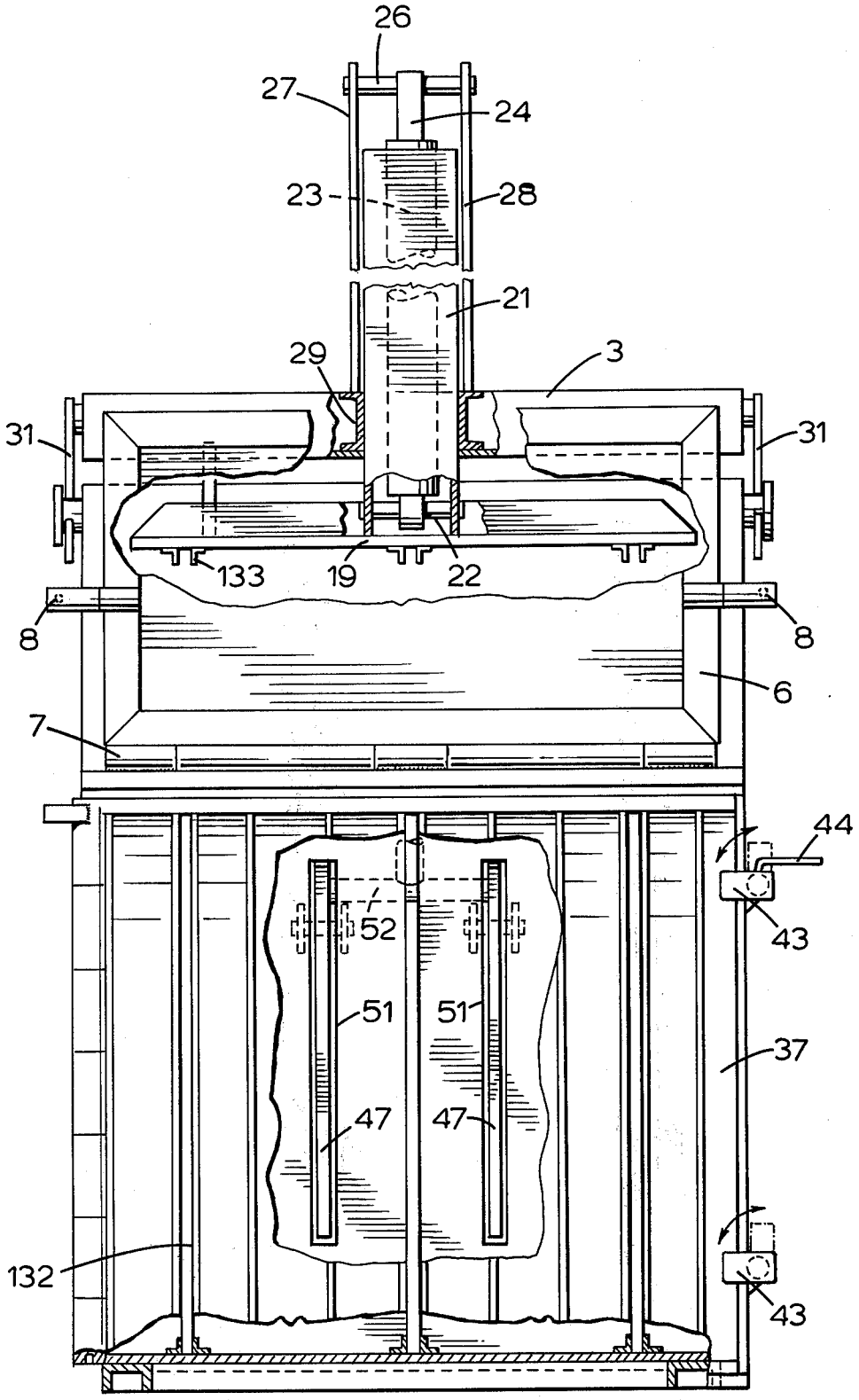
FIG. 3 is a partially cut away front view of the baler.

If it is wished to place baling wire or other strapping 131 around the baled material at this stage, as shown in FIG. 9, the strapping can be introduced through a set of slots 132 in the lower door 37, as shown in FIG. 3.

The underside of the platen 19 is provided with a set of rib pairs 133 which form grooves in the upper surface of the bale and assist in passing the strapping around the bale. The strapping can be fastened together with a cinch 134 as shown in FIG. 9.

In order to remove the bale, the lower door 37 is opened fully, and the normally open door closed switch 89 becomes open while the normally open door open switch 88 becomes closed. The motor M becomes reconnected through the closed switch 88 and starts to drive the pumps 92 and 93. At this point, the relay coil $C_2$ and the solenoids 112 and 113 are in the energised state, so that the flow of hydraulic fluid through the valves 109 and 111 is urging both the lid 3 and the platen 19 in the downward direction, while $C_1$ is disconnected, and the pressure switch 104 connects a contact 136 to the motor M.

The arm 54 on the kicker lever is now rocked forwards by hand and the gate pin 58 is raised and lowered to engage the rear surface of the jug 57 as shown in FIG. 9, so that the recess 55 is aligned with the cross bar 63.

The up button 75 is pushed to momentarily connect contacts 137 and 138, respectively. The relay coil $C_1$ becomes connected through the contacts 138. The effect of this is to cause upward movement of the platen 19 to commence, through opening of the contacts $C_1(1)$ and $C_1(2)$ in a manner similar to that described above in relation to the actuation of the ram down switch 81, so that the platen-raising and lid-opening portions of the cycle take place as described above.

Figure 10:
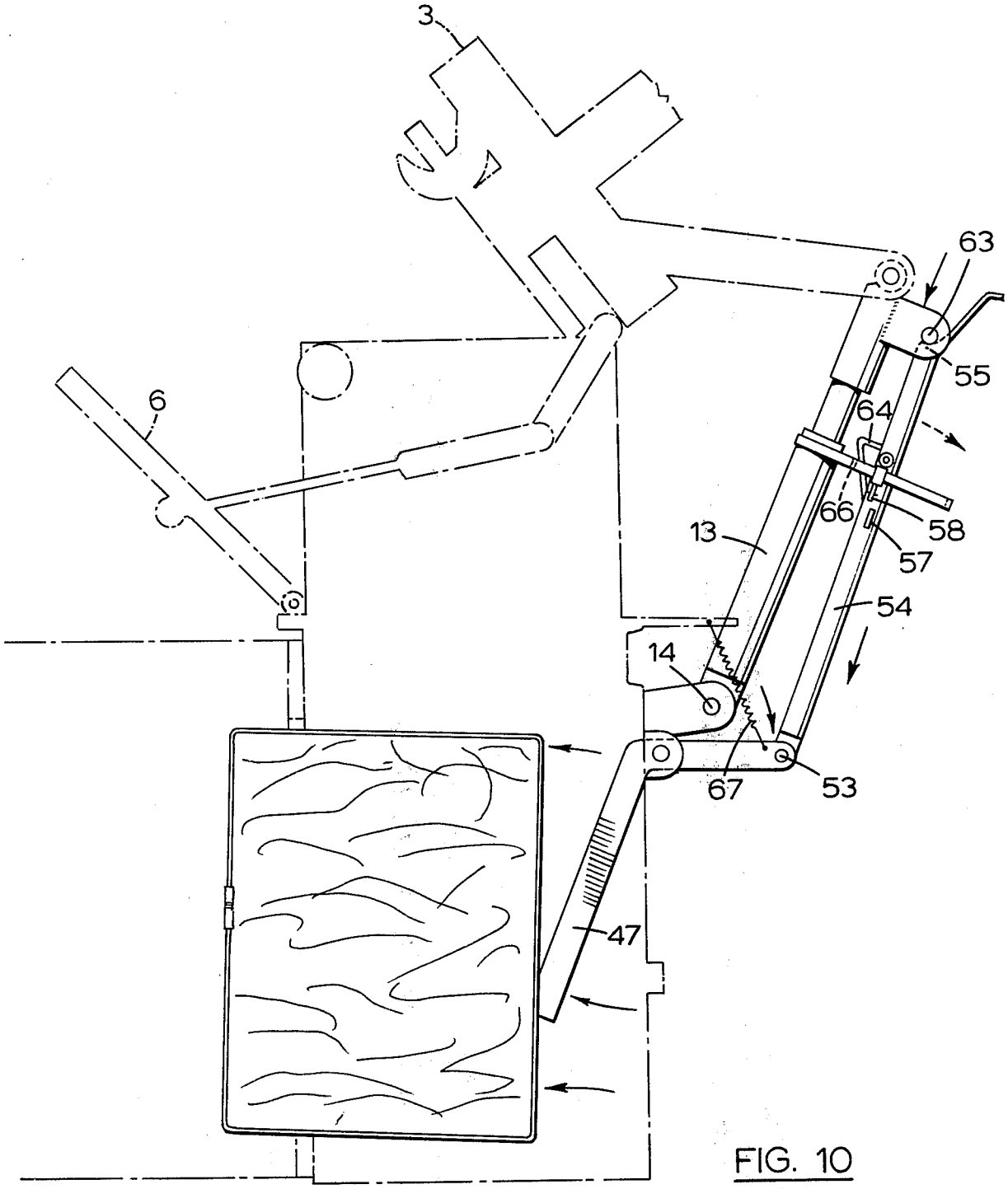

As the lid opens, the cross bar 33 contacts the recess 55 on the upper end of the arm 54 and the kicker levers 47 are rocked forwardly as shown in FIG. 10 to eject the completed bale.

Figure 8:
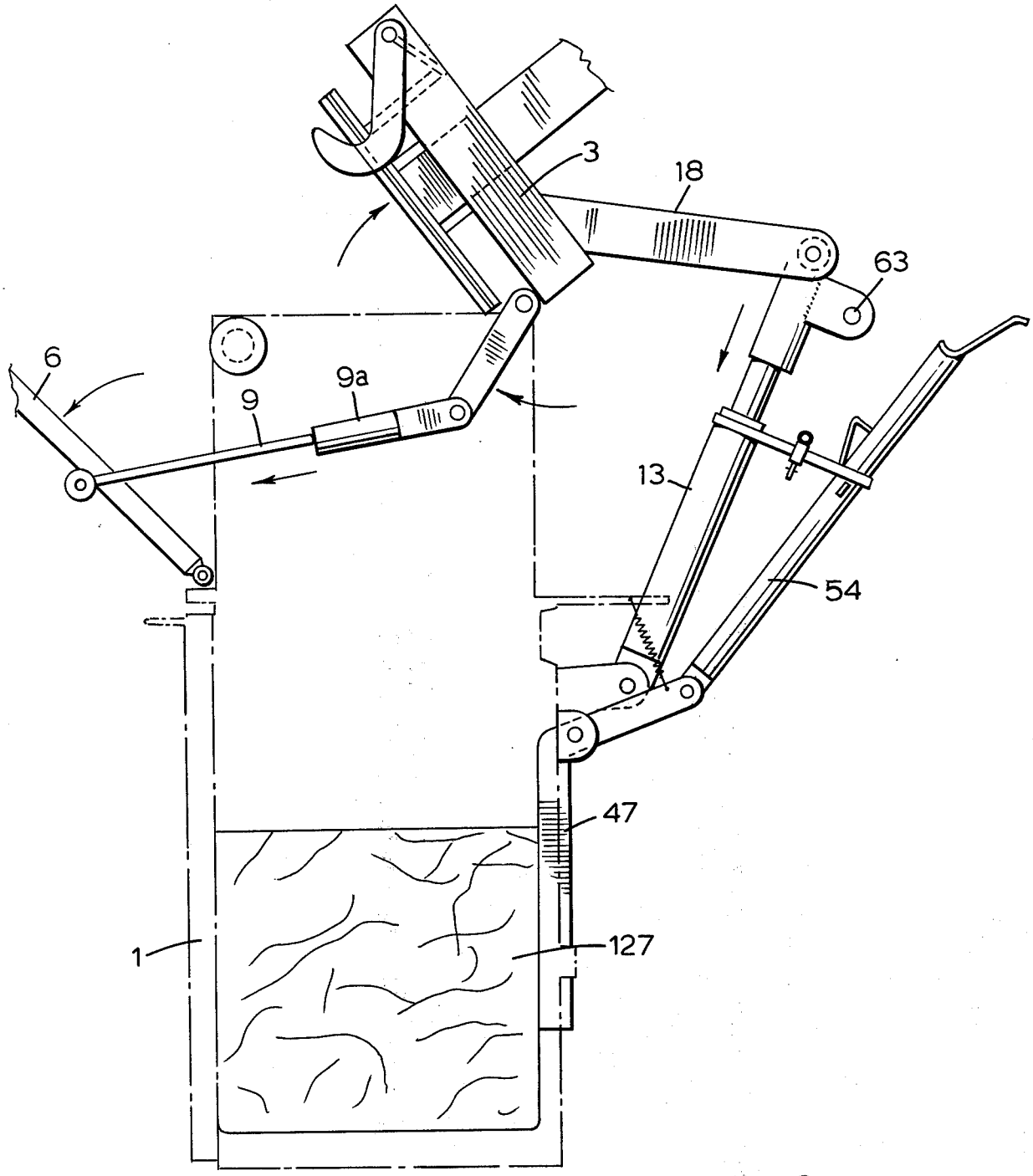
FIGS. 8 to 10 show side views of the baler in different stages of operation.

Almost immediately, the arm 54 moves downwardly relative to the cylinder 13, because of the relative position of the pivots 14 and 53 so that the lug 57 frees itself from the gate pin 58. The cam 64 reacts with the cross-piece 66 to urge the arm 54 away from the cylinder 13 and free the recess 55 from the cross bar 63. The tension spring 67 pulls on the upper end of the kicker lever 47, and the kicker lever 47 and the arm 54 are restored to their original position as shown in FIG. 8.

If desired, a piece of stiff material such as cardboard can be placed in the bottom of the body 1 before material to be baled is added. After use, when the maximum compaction pressure has been reached and the motor M has stopped, the platen 19 can be raised to allow a further piece of stiff material to be placed on top of the completed bale.

In order to raise the platen 19, to place the second piece of stiff material on the bale, the up button 75 is pushed. When the up button is pushed the motor M is temporarily connected through the contact 136 of the pressure switch 108 and through the contacts 138 of the push button. As the pressure in the hydraulic system eases, with the lifting of the platen 19, the pressure switch 108 moves off the contact 136 and reconnects the motor M, so that the platen 19 can be raised even when the lower door 37 is closed and the door closed switch 88 is open.

Pressing the up button 75 causes the baler to proceed through the platen-raising and lid-opening parts of the operating cycle. After the second piece of stiff material has been added, the start button 73 is pushed to cause the lid 3 to lower and the platen 19 to descend. The above described procedure for ejecting the bale from the body 1 can then be followed.

It should be noted that the up button 75 can be pushed to raise the platen 19 and the lid 3 if the platen 19 encounters an obstruction sufficient to actuate the pressure switch 104 and stop the motor M. On pressing the up button 75, the platen 19 will move upward and the lid 3 will open, to allow access to the inside of the body 1 for freeing or removing the obstruction.

The electrical controls include a stop push button 74 which can be pushed to disconnect the relays $C_1$ and $C_2$ and halt the baler at any stage in the cycle of operation.

The up button 75 can be used for re-starting the baler at various positions in the operating cylce in the event of the baler operation being halted by a failure in the electricity supply, or after pressing the stop button 74.

The hold switch 78 can be opened to disconnect the motor M at any stage of the cycle and temporarily halt the baler.

As shown in FIG. 1, the compact construction of the baler permits it to be mounted on a rectangular frame formed of angle brackets 141 on the underside of which are secured legs 142 rotatably mounting wheels 143, thus allowing the baler to be moved easily from one position to another.

It will be appreciated that the baler particularly described above with reference to the drawings is merely an example of the present invention, and that modifications may be made to the structure described.

What I claim as my invention is:

1. A baler comprising a container having an open upper end for introducing material to be baled, a platen mounted on a support at the upper end of the container and movable relative to the support in up and down movement in the container, connecting means between the support and the container permitting the support together with the platen to be swung upwardly toward a rear side of the container, a door pivotally connected on the container at an upper region of a front side thereof, first drive means operable to move the platen up and down in the container for compressing material therein, second drive means operable to swing the platen together with the support upwardly and rearwardly and to return them downwardly and forwardly, and linkage means between the support and the door providing for the door to swing forwardly and downwardly as the platen and the support swing upwardly and rearwardly.

2. A baler as claimed in claim 1 wherein the linkage means comprise a downwardly extending lever connected to the support and an arm pivotally connected to the lever and to the door.

3. A baler as claimed in claim 1 including a lower door pivoting on the front of the container, a kicker lever connected for forward and rearward pivoting on the rear of the container, a slot in the lower region of the container through which the lower end of the lever can enter the container, and engagement means whereby the second drive means can be selectively engaged with the kicker lever to pivot an end thereof forwardly into the container to eject baled material from the container.

4. A baler according to claim 3 wherein the second drive means comprise a vertically-extending pressure cylinder pivotally connected to the rear of the container, with a ram working in the cylinder, and a linkage between the ram and the support; and wherein the kicker lever is aligned vertically with the cylinder and ram and has a reaction surface connected on an end thereof for contact with an abutment member connected on an end of the ram; and said engagement means include a catch member co-operating between the cylinder and the kicker lever to hold the reaction member releasably in alignment with the abutment member of the ram.

5. A baler as claimed in claim 4 wherein the kicker lever has a kicker arm pivotally connected on an end thereof, the kicker arm having the reaction surface on an end thereof remote from the pivotal connection to the kicker lever whereby the kicker arm moves vertically as the kicker lever swings forwardly.

6. A baler as claimed in claim 5 wherein said catch member releases said kicker arm as said kicker arm moves vertically.

7. A baler as claimed in claim 6 wherein one of the cylinder and the kicker arm has a cam thereon for reacting with the other one of the cylinder and the kicker arm, the cam urging the kicker arm away from the cylinder as the kicker arm moves vertically.

* * * * *